United States Patent [19]

Hisatake et al.

[11] 4,331,092

[45] May 25, 1982

[54] PATTERN CAM POSITIONING MEANS IN STOPPING DEVICE FOR SEWING MACHINES

[75] Inventors: Michio Hisatake, Hino; Noboru Kasuga; Yasuro Sano, both of Hachioji, all of Japan

[73] Assignee: Janome Sewing Machine Co., Ltd., Tokyo, Japan

[21] Appl. No.: 175,203

[22] Filed: Jul. 31, 1980

[30] Foreign Application Priority Data

Aug. 2, 1979 [JP] Japan ..... 54-106126[U]
Nov. 5, 1979 [JP] Japan ..... 54-152422[U]

[51] Int. Cl.[3] ..... D05B 3/02; D05B 69/22

[52] U.S. Cl. ..... 112/275; 112/158 A; 112/158 E

[58] Field of Search ..... 112/158 A, 158 E, 158 B, 112/158 D, 275, 277

[56] References Cited

U.S. PATENT DOCUMENTS 4,246,858 7/1979 Ogawa ..... 112/275
4,265,188 5/1981 Suzuki et al. ..... 112/275 X

*Primary Examiner*—Peter P. Nerbun
*Attorney, Agent, or Firm*—Michael J. Striker

[57] ABSTRACT

A cycle stitching device for a sewing machine includes a switch automatically operated to deenergize the drive motor of the machine and simultaneously energize a solenoid for activating a stopping device that stops the sewing machine with the needle located at a predetermined position, and pattern cam means stopped at a predetermined position thus permitting the stitching of the subsequent pattern exactly from the initial stitch coordinate.

8 Claims, 6 Drawing Figures

PATTERN CAM POSITIONING MEANS IN STOPPING DEVICE FOR SEWING MACHINES

BACKGROUND OF THE INVENTION

The invention relates to a sewing machine, and more particularly relates to a cycle stitching device for a sewing machine.

As to the conventional sewing machines provided with pattern cams, it is impossible for the machine operator to know whether these pattern cams are positioned to produce an initial stitch of the patterns before the sewing machine is used. Actually these pattern cams are usually stopped at an indefinite angular position. In this case, a selected pattern is initiated from a different stitch coordinate of the pattern. For stitching a pattern on a series of different patterns, it is desirable to initiate such patterns always from the initial stitch coordinates of the respective patterns. This is, however, impossible with the sewing machine which is operated to start and stop by an operator-controlled switch. If this is possible, an elaborate care is required on the machine operator.

SUMMARY OF THE INVENTION

The present invention has been provided to eliminate such defects and disadvantages of the prior art.

It is a primary object of the invention to provide a sewing machine with a cycle stitching device which is simple in structure and easy in operation for producing a complete pattern of cycle stitches.

It is another object of the invention to automatically stop the sewing machine with the needle located at a predetermined position after a complete cyclic pattern is produced.

It is another object of the invention to sequentially produce the pattern of cycle stitches with operation of an operator-controlled switch.

The novel features and advantages which are considered as characteristic for the invention will be apparent from the following description of a specific embodiment of the invention in reference to the accompanying drawings.

DESCRIPTION OF THE PREFERRED EMBODIMENTS

Figure 1:
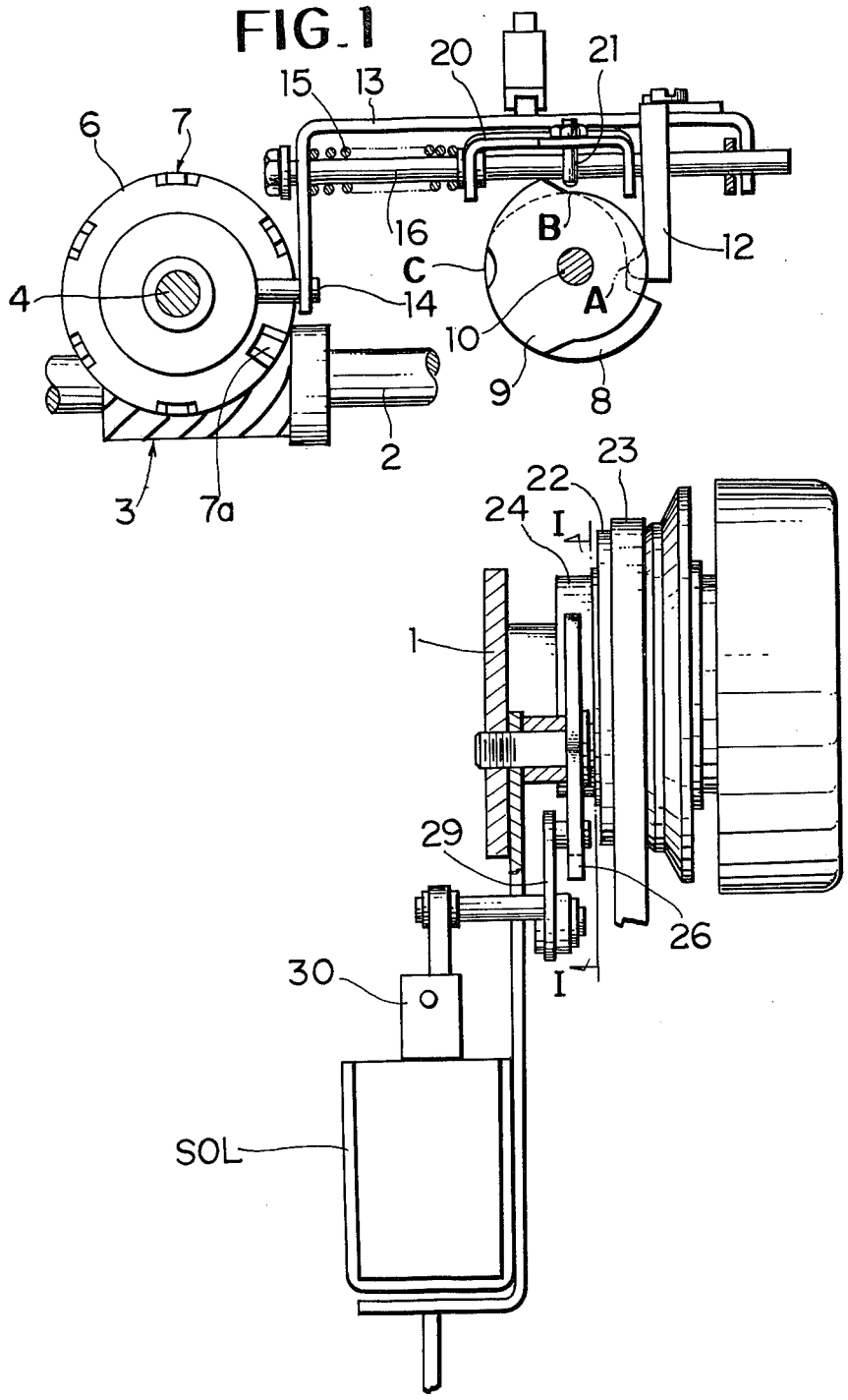
FIG. 1 is an outlined front elevational view of a machine mechanism showing an embodiment of the invention.
Figure 2:
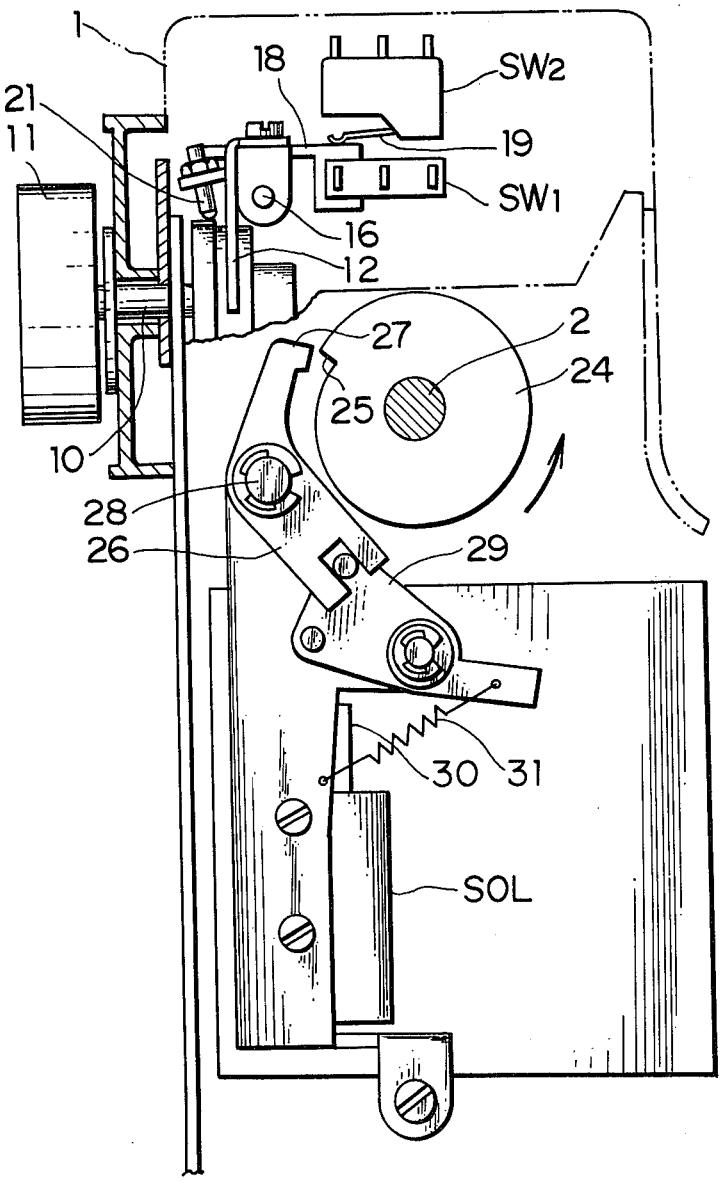
FIG. 2 is a side elevational view of the above taken along the line I—I.
Figure 3:
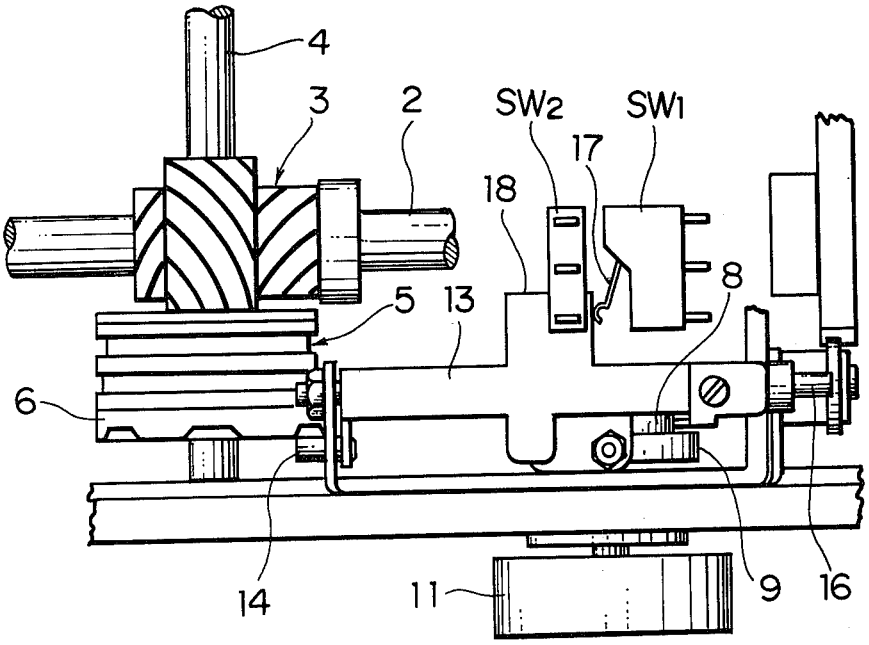
FIG. 3 is a plan elevational view of the above.

Referring to FIGS. 1, 2 and 3, the reference numeral 1 identified a machine housing, and the numeral 2 denotes an upper shaft of the sewing machine. The rotation of the upper shaft is transmitted through a worm 3 to a shaft 4 at a reduced speed with the ratio 6:1. The shaft carries a group of pattern cams 5 for rotation therewith. If a pattern is selected, a follower (not shown) engages the corresponding one of the pattern cams 5 to control the lateral swinging movement of the needle. Each of the patterns is formed with six stitches. A fabric feed control mechanism and a stitch forming mechanism are omitted in the drawings to simplify the explanation of the invention. The numeral 6 is a disk cam for detecting the final stitch of a pattern, and is formed with six tapered grooves 7 on one side and the periphery thereof as shown. One 7*a* of the grooves 7 is radially longer than the others and is used for a pattern of cycle stitches as will be later mentioned. These six grooves are provided for intermittent stitches. The numeral 8 denotes a stitch type selecting cam, and the numeral 9 is a releasing cam. Those cams 8, 9 are secured on a shaft 10 and are manually rotated by a stitch type selecting dial 11. A follower 12 is in engagement with a face of the selecting cam 8. When the follower 12 engages the cam face A of minimum diameter as shown, the straight stitch is selected. When the dial 11 is rotated 90° in the clockwise direction, the follower 12 engages the cam face B of medium diameter, and then the cycle stitch is selected. When the dial is rotated further 90°, the follower 12 engages the cam face C of maximum diameter, and then the intermittent stitch is selected. The follower 12 displaces, to the right and left in FIG. 1, a phase detecting arm 13 supporting the follower 12 in dependence upon the engagement of the follower 12 with the cam faces A, B and C, thereby to displace a detecting pin 14 held on the detecting arm 13 to the right and left. The numeral 15 is a spring mounted on a shaft 16 to bias the arm 13 toward the left in FIG. 1. The arm 13 is mounted on the shaft 16 and is normally biased by a spring (not shown), in the counterclockwise direction in FIG. 2. Thus follower 12 is pressed against the periphery of cam 8, and the pin 14 is pressed against the front side of cam 6. Therefore, when the follower engages the cam face A of cam 8, the pin 14 will not engage any of the grooves 7 of cam 6 while the machine is driven. If the follower 12 engages the cam face B, the pin 14 will engage only the radially longer groove 7*a*, and then the arm 13 is turned in the counterclockwise direction in FIG. 2. If the follower 12 engages the cam face C, the pin 14 engages all of the grooves 7, and therefore, at each time of the engagement, the arm 13 is turned in the counterclockwise direction.

$SW_1$ is a stitch type selecting switch, and the actuator 17 is moved to operate the switch $SW_1$ by an axial movement of the abutment 18 of the phase detecting arm 13 in dependence upon the engagement of the follower 12 with the cam faces A, B and C.

$SW_2$ is a final stitch detecting switch and the actuator 19 is moved to operate the switch $SW_2$ by a turning movement of the abutment 18 in dependence upon the engagement of the pin 14 with the grooves 7.

The numeral 20 is a releasing arm carrying a follower pin 21 and is turnably mounted on the shaft 16. The pin 21 cooperates with the releasing cam 9 to turn the arm 13 in the clockwise direction, thereby disengaging the pin 14 from the groove 7 each time when the arm 13 is axially moved in the leftward direction, so that the stitching type may be changed. The numeral 22 is a pulley which is, as shown, mounted on one end of the upper shaft 2 and receives the driving force of a machine motor (not shown) via belt 23. The numeral 24 denotes a stopping cam secured to the upper shaft 2 to stop the upper shaft 2 when the abutment 25 of the cam 24 engages the end 27 of a pawl 26 which is turnably mounted on a pivot 28 secured to the machine housing 1. The pawl 26 is connected to a plunger 30 of an electromagnetic solenoid SOL via a link 29 which is normally biased in the clockwise direction by a spring 31 to locate the end 27 of pawl 26 at a position spaced from the rotation path of the abutment 25 of cam 24 as shown in FIG. 2. If the solenoid is energized, the plunger 30 is pulled down and turns the link 29 in the counterclockwise direction against the action of the spring 31. The pawl 26 is, therefore, turned in the clockwise direction, and the end 27 is brought into the rotation path of the abutment 25 of the cam 24. The solenoid SOL is not energized while the sewing machine is driven for normal stitching. In this case, a clutch (not shown) transmits the rotation of the pulley 22 to the upper shaft 2, and on the other hand, when the solenoid is energized to stop the sewing machine, the clutch is operated to disconnect the upper shaft 2 from the pulley 22.

Figure 4:
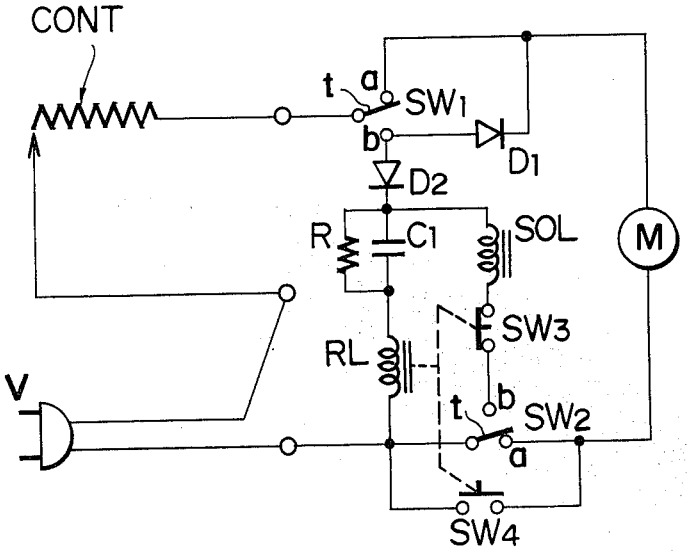
FIG. 4 is a control circuit diagram of the invention.

FIG. 4 shows a control circuit diagram, in which V is AC power source, M is a machine motor, and CONT is a controller of resistance line type. When the follower 12 contacts the cam face A of the stitch type selecting cam 8 for the straight stitch, the contact piece (t) of the stitch type selecting switch $SW_1$ is positioned at a contact point (a), and when the follower 12 contacts the cam faces B or C, the contact piece (t) is brought to a contact point (b). A diode $D_1$ is employed to rectify the half-wave of the electric current of the motor M, thereby to reduce the rotation speed of the motor, and especially the diode $D_1$ composes a rotation speed reducing device together with the switch $SW_1$. When the detecting pin 14 is not dropped in any of the grooves 7 of the final stitch detecting cam 6, the contact piece (t) of the final stitch detecting switch $SW_2$ is positioned at the contact point (a), and when it is dropped in any one of the grooves 7, the contact point (t) is positioned at the contact b. Therefore, when the follower 12 engages the cam face A for the straight stitch, the contact (t) is positioned at the contact point (a), and when the follower 12 engages the cam face B for the cycle stitch, the contact (t) is brought to the contact point (b) once per rotation of the cam 6. With the needle stopped at a predetermined position, that is, once per six stitches, and this condition detects the final stitch of six stitches. When the follower 12 engages the cam face C for the intermittent stitch, the contact (t) of the switch $WS_2$ is brought to the contact (b) once per 1/6 rotation of the cam 6 that is, per one stitch with the needle stopped at a predetermined position. RL is a relay coil which is energized for a predetermined time via a diode $D_2$ and a capacitor $C_1$ when the contact piece (t) of the switch $WS_1$ is at the contact point (b) and the controller CONT is operated. The energizing time is based on the reactance and resistance of the coil RL and the capacitor $C_1$. R is a resistor to cause the capacitor $C_1$ to discharge when the controller CONT is released. The above said electromagnetic solenoid SOL is connected at its one side to the contact point (a) of the switch $SW_1$ via the diode $D_2$, and is connected at the other side to the contact point (b) of the switch $SW_2$ via a normally closed switch $SW_3$ which is opened by energization of the relay RL. $SW_4$ is a switch which is closed by energization of the relay RL, thereby to then short-circuit the contact piece (t) of the switch $SW_2$ and the contact point (a).

In the above mentioned structure, when the follower 12 is engaged to the cam face A of the stitch type selecting cam 8 by manual operation of the stitch type selecting dial 11 for selecting the straight stitch, the contact piece (t) of the stitch selecting switch $SW_1$ is brought to the contact point (a), and the detecting pin 14 is moved to the left side as shown in FIG. 1 where the pin will not engage any of the grooves 7 of the final stitch detecting cam 6, and where the contact piece (t) of the final stitch detecting switch $SW_2$ is brought to the contact point (a). Therefore the machine motor M is speed-controlled by the controller CONT, and since the electromagnetic solenoid SOL is non-energized, the pawl 26 is not in the rotation path of the stop cam 24 and the pulley 22 and the upper shaft 2 are connected by the clutch and the sewing machine is driven in the normal controlled speed.

When the follower 12 engages the cam face B of the stitch type selecting cam 8 for selecting the cycle stitch, the contact piece (t) of the stitch selecting switch $SW_1$ is brought to the contact point (b), and the detecting pin 14 is positioned at the medium position in the displacing range in FIG. 1 ready for dropping into only the groove *7a*. The contact piece (t) of the switch $SW_2$ is at the contact point (a) while the pin 14 is not in the groove *7a* does not meet the pin 14. Then the machine motor M is speed-controlled by the controller CONT, and the speed is reduced by the diode $D_1$. The relay coil RL is temporally energized, as the controller CONT is operated, to open the switch $SW_3$ and close the switch $SW_4$. Such operations of switches $SW_3$, $SW_4$ give no influence to the drive of motor M when the pin 14 is not in the groove *7a*, because the contact piece (t) of switch $SW_2$ is at the point (a) at that time. When the pin 14 is in the groove *7a*, that is, when the contact piece (t) of the switch $SW_2$ is at the contact (b), the circuit of the solenoid SOL is broken and the circuit of the motor M is made operative to rotate the motor, so that the relay RL is energized until the pin 14 gets out from the groove *7a*, that is, until the contact piece (t) comes to the contact point (a) for starting the machine motor M. When the pattern is stitched after the cam 6 makes one complete rotation and the pin 14 meets to groove *7a* again, the contact piece (t) of the switch $SW_2$ comes to the contact point (b) and the current of the motor M is broken, and then, since the capacitor $C_1$ has been charged, the relay RL is not energized and therefore the solenoid SOL is energized to stop the upper shaft 2 as aforementioned, and at the same time, the clutch disconnects the upper shaft 2 from the pulley 22. Thus the sewing machine is stopped with the needle located at a predetermined position, e.g., at the upper dead point of thereof. Subsequently, the controller CONT is released once to discharge the capacitor $C_1$. By re-operating the controller CONT, the initial stitch of the pattern is started and the final stitch is formed and the sewing machine is stopped. If the pin 14 is not in the groove *7a* at the start of stitching, the motor M is rotated before until the pin 14 comes to the groove *7a* before the fabric is set to the sewing machine.

Figure 5:
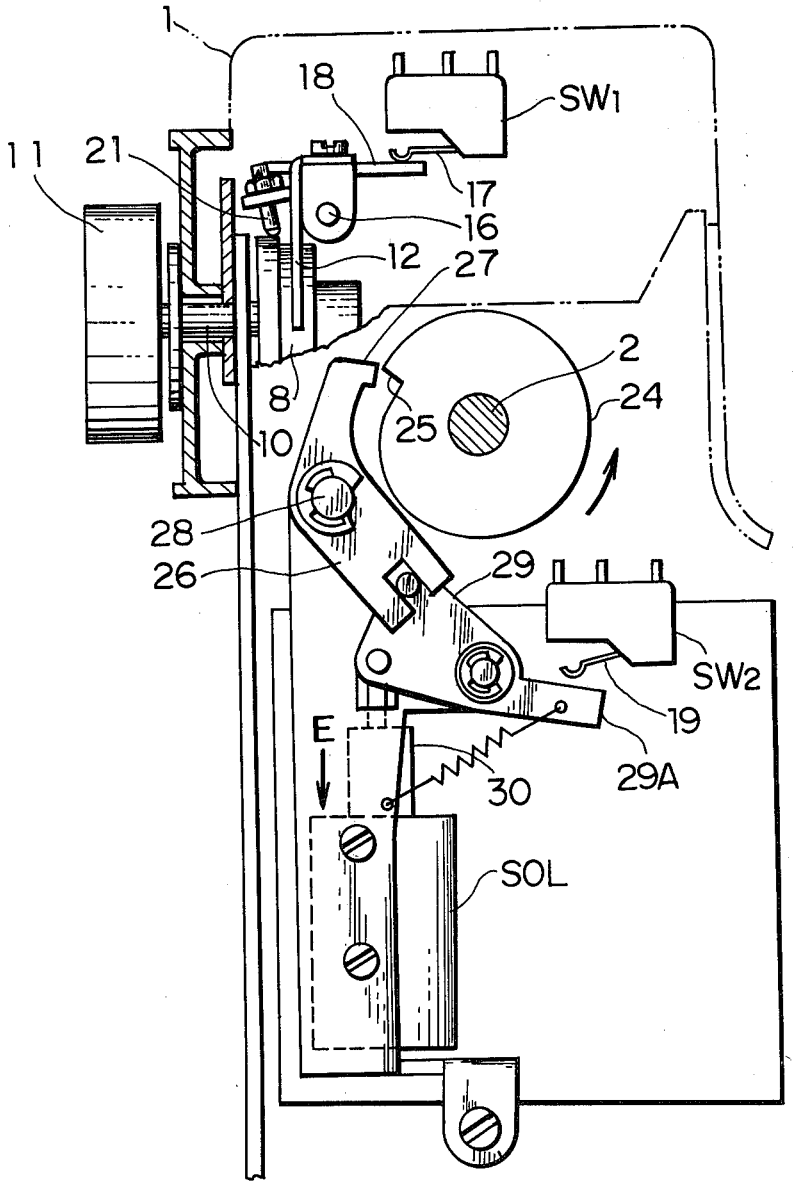
FIGS. 5 and 6 show another embodiment of the invention.
Figure 6:
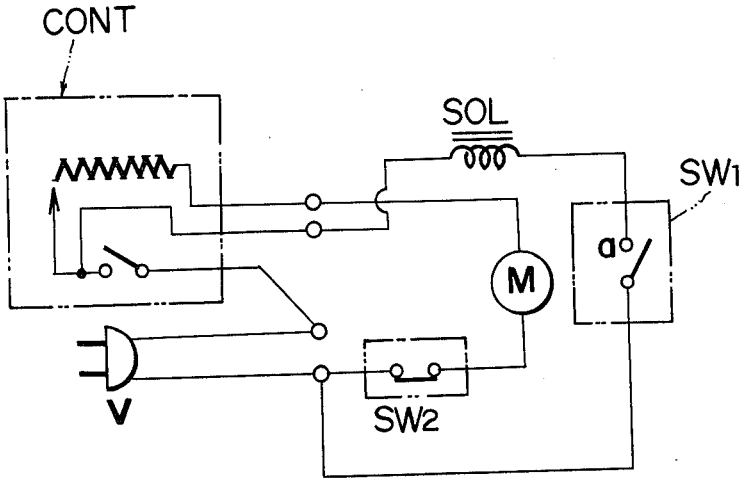

When the follower 12 engages the cam face C of the stitch type selecting cam 8 for selecting the intermittent stitch, the detecting pin 14 is moved further to the right in FIG. 1 ready for dropping into all of the six grooves 7. While in the cycle stitch, the sewing machine is automatically stopped after a predetermined number of stitches, for example, six stitches are produced, in the intermittent stitch the sewing machine is stopped with the needle located at a predetermined position each time after one stitch is produced by operation of the controller CONT. FIGS. 5 and 6 show another embodiment of the invention, in which the switch $SW_1$ is normally opened, and is closed due to the turning movement of the arm 13 when the pin engages one of the grooves 7, thereby to energize the solenoid SOL to stop the rotation of the upper shaft 2. The switch $SW_2$ is arranged near the intermediate link 29, and is normally closed, and is opened by the part 29A of the intermediate link 29 which is turned in the counterclockwise direction to stop the rotation of the upper shaft 2 through the pawl 26 when the solenoid SOL is energized.

According to the embodiment, the stop cam 24 is normally biased in the counterclockwise direction by a spring (not shown). As aforementioned, if the solenoid SOL is energized, the end 27 of the pawl 26 is turned in the clockwise direction into the rotation path of the abutment 25 of the stop cam 24, thereby to stop the rotation of the upper shaft at the end of cycle stitches. The pawl 26 is, however, brought out of the rotation path of the stop cam 24 by an appropriate device (not shown) when the machine controller CONT is released. The stop cam 24 is, therefore, turned a little in the counterclockwise direction by the spring (not shown) until the abutment 25 comes to a level lower than the end 27 of the pawl 26, so that the upper shaft 2 may be rotated again when the controller CONT is operated again.

As would be understood in this embodiment, if the controller CONT is released after a pattern of cycle stitches is completed, the circuit in FIG. 6 is completely deenergized. The switch $SW_1$ remains closed because the pin 14 is in one of the grooves 7. The solenoid SOL is, therefore, energized when the controller CONT is operated again and moves the pawl toward the rotation path of the stop cam 24. This, however, gives no influence to the rotation of the upper shaft 2, because, as mentioned, the abutment 25 of stop cam 24 is positioned in a level lower than the end 27 of the pawl 26. As the upper shaft 2 is rotated and the cam 6 is rotated accordingly at a reduced speed, the pin 14 comes out of one of the grooves 7, and then the switch $SW_1$ is opened as aforementioned. The switch $SW_1$ is, therefore, closed again to energize the solenoid SOL to stop the upper shaft 2 when a pattern of cycle stitches is completed and the pin 14 is dropped into one of the grooves 7 of the cam 6.

It will be understood that each of the elements described above, or two or more together, may also find a useful application in other types differing from the types described above.

What is claimed as new and desired to be protected by Letters Patent is set forth in the appended claims:

1. A cycle stitching device for a sewing machine having an upper drive shaft rotated to vertically reciprocate a needle bar with a needle, a group of pattern cams rotated at a predetermined speed by the upper drive shaft, follower means selectively engaging the pattern cams and operatively connected to the needle bar to control the lateral swinging movement of the latter, a pulley mounted on one end of the upper drive shaft, a machine drive motor for driving the pulley, an operator-controlled switch operated to electrically drive the machine motor, a clutch normally connecting the upper drive shaft to the pulley, and stopping means including a solenoid electrically energized to stop the upper drive shaft at a predetermined angular position thereof, said solenoid simultaneously operating the clutch to disconnect the upper drive shaft from the pulley, said cycle stitching device comprising control means rotated at a predetermined speed by the upper drive shaft; setting means manually operated and displaced in a first direction relative to the control means and cooperating with the control means and displaced in the second direction at a predetermined angular position of the control means; first switch means electrically connected to the operator-controlled switch and operated by the displacement of the setting means in the first direction to start the machine drive motor at a predetermined speed; and second switch means normally closed to energize the machine drive motor together with the first switch means, and opened by the displacement of the setting means in the second direction to deenergize the machine drive motor and then to energize the solenoid.

2. A cycle stitching device as defined in claim 1, wherein said control means comprises a disk cam rotated at a predetermined speed by the upper drive shaft, said disk cam formed with a groove radially spaced from the rotation axis thereof.

3. A cycle stitching device as defined in claim 1, wherein said control means comprises a disk cam rotated at a predetermined speed by the upper drive shaft, said disk cam formed with a plurality of grooves each radially spaced from the rotation axis thereof.

4. A cycle stitching device as defined in claim 1, wherein said setting means comprises a setting cam, and an arm mounted on a support shaft, said arm having one end kept in engagement with the setting cam and the other end supporting a follower pin cooperating with the control means, said arm being displaced by the setting cam axially of the support shaft to operate the first switch means, and being turnable around the support shaft at a predetermined angular position of the control means.

5. A cycle stitching device as defined in claim 1, wherein one of said first and second switch means may be normally closed to energize the machine motor, and the other switch means may be normally opened to deenergize the solenoid, said other switch means being closed by the displacement of the setting means in the second direction to operate the stopping means, and said first mentioned switch means being opened by the stopping means to deenergize the machine drive motor.

6. A cycle stitching device as defined in claim 1, further comprising release means manually operated to release the setting means from the control means for the purpose of selecting a different type of cycle pattern.

7. A cycle stitching device as defined in claim 6, wherein said release means comprises a release cam, and a cam follower operated by the release cam to displace the setting means in the direction opposite to the second displacing direction thereof.

8. A cycle stitching device as defined in claim 1, further comprising reset means temporarily operated to deenergize the solenoid and energize the machine drive motor when the operator-controlled switch is reoperated after a pattern is produced.

* * * * *